United States Patent [19]

Mostaghel

[11] Patent Number: 4,633,628

[45] Date of Patent: Jan. 6, 1987

[54] DEVICE FOR BASE ISOLATING STRUCTURES FROM LATERAL AND ROTATIONAL SUPPORT MOTION

[75] Inventor: Naser Mostaghel, Salt Lake City, Utah

[73] Assignee: University of Utah, Salt Lake City, Utah

[21] Appl. No.: 794,249

[22] Filed: Oct. 31, 1985

[51] Int. Cl.[4] ..... E02D 27/34

[52] U.S. Cl. ..... 52/167; 52/573

[58] Field of Search ..... 52/167, 393, 573; 14/16.1; 248/562, 632, 636, 638

[56] References Cited

U.S. PATENT DOCUMENTS

| | | | |
|---|---|---|---|
| 3,921,240 | 11/1975 | Fyfe | 52/573 X |
| 4,033,005 | 7/1977 | Czernik et al. | 14/16.1 |
| 4,121,393 | 10/1978 | Renault et al. | 52/167 |
| 4,238,137 | 12/1980 | Furchak et al. | 52/167 X |
| 4,499,694 | 2/1985 | Buckle et al. | 52/167 |
| 4,554,767 | 11/1985 | Ikonomou | 52/167 |

*Primary Examiner*—Carl D. Friedman
*Assistant Examiner*—Creighton Smith
*Attorney, Agent, or Firm*—K. S. Cornaby

[57] ABSTRACT

The device of the invention comprises a set of flat rings which can slide laterally on each other with a central rubber core and/or peripheral rubber cores. In this base isolator device the interfacial friction force acts in parallel with the elastic force in the rubber. It combines the beneficial effect of friction damping with that of the resiliency of rubber. The rubber cores distribute the sliding displacement along the height of the device and, due to rubber's resiliency, limit the maximum residual displacement at the base to a pre-specified value, thereby eliminating the need for any repositioning operation after earthquakes. Also, the resiliency of the rubber cores aid in reducing the high frequency effects attributed to friction isolators.

11 Claims, 7 Drawing Figures

DEVICE FOR BASE ISOLATING STRUCTURES FROM LATERAL AND ROTATIONAL SUPPORT MOTION

BACKGROUND OF THE INVENTION

The transmission of ground motion, such as caused by earthquakes, to structures has been attempted to be controlled through isolation of the structure at its base. This has involved specially designed foundation systems that limit the intensity of the ground motion transmitted to the superstructures. As noted in the prior art, prior traditional methods of providing for lateral load-carrying capacity allow the entire ground motion from an earthquake to be transmitted to the superstructure and then attempt to provide for the absorption of the energy through inelastic structural materials, which inevitably gives rise to damage to structural and non-structural elements.

The concept of limiting the intensity of motions transmitted to the structures via certain base isolation schemes has been explored in the prior art. Besides the classical spring-mass system, whic is based on harmonic excitations, there are many other suggestions in the art to isolate structures from the damaging effects of earthquakes. The flexible first story concept and the soft story concept, due to consequential instability and P Δ effects, are not practical schemes. The use of ball bearings and specially shaped rollers under the structures has also been suggested.

Considerable work has been done to show the effectiveness of steel plate laminated rubber bearings with and without a lead core as a base isolator system. To limit the shear distortion in the elastomer and to bestow larger displacement capability, the use of a friction plate in conjunction with steel plate laminated rubber bearings has also been considered. If the predominant frequency of excitation is low (as in the case of a soft site), the above systems can act as amplifiers and impose larger displacement demands on the base.

After the ground motions of a typical earthquake stop, there are residual displacements in the sliding type isolators. Since these residual displacements can increase in subsequent earthquakes, repositioning operations become necessary. It would therefore be desirable to provide a base isolator system which is endowed with elastic elements which limit the maximum residual displacement to a constant specified quantity and eleminate or reduce the need for repositioning operations.

SUMMARY OF THE INVENTION

The base isolation system of the invention provides a stack of flat rings having the capability of lateral and rotational sliding motion with respect to each other. The rings have a central unattached rubber core and/or a plurality of peripheral unattached rubber cores with top and bottom securing plates. A preferred embodiment has a rubber cover over the rings to protect them from corrosion and dust. The function of the rubber cores is to distribute the lateral displacement due to earth movement across the height of the stack of sliding rings. Since the rubber is resilient, the maximum residual displacement is limited to a prespecified value, thereby eliminating the need for repositioning after earthquakes.

The base isolator device is characterized by the coeffecient of friction of the sliding rings and the total lateral stiffness of the rubber core or cores. The damping capacity of the rubber is small and the friction damping is the main energy dissipator of the device. Construction is relatively simple, since the rubber cores are only fitted, but not bound to the sliding rings.

THE DRAWINGS

Preferred embodiments of the invention are shown in the accompanying drawings, in which:

FIG. 1 is a perspective view of a preferred embodiment of the invention showing the interior of the device in cut-away;

FIG. 2, a plan sectional view of the embodiment taken along Line 2—2 of FIG. 1;

FIG. 3, an elevational section of the embodiment taken along Line 3—3 of FIG. 1;

FIG. 4, an elevational section of the embodiment shown in FIG. 3 showing the base isolator device distorted by lateral forces;

FIG. 5, a top plan view of another preferred embodiment of the invention, showing a circular rubber core and square sliding plates;

FIG. 6, a top plan view of yet another preferred embodiment of the invention, showing a rectangular rubber core and circular sliding plates; and FIG. 7, a top plan view of still another preferred embodiment of the invention, showing a rectangular rubber core and rectangular sliding plates.

DETAILED DESCRIPTION OF THE ILLUSTRATED PREFERRED EMBODIMENTS

Figure 1:
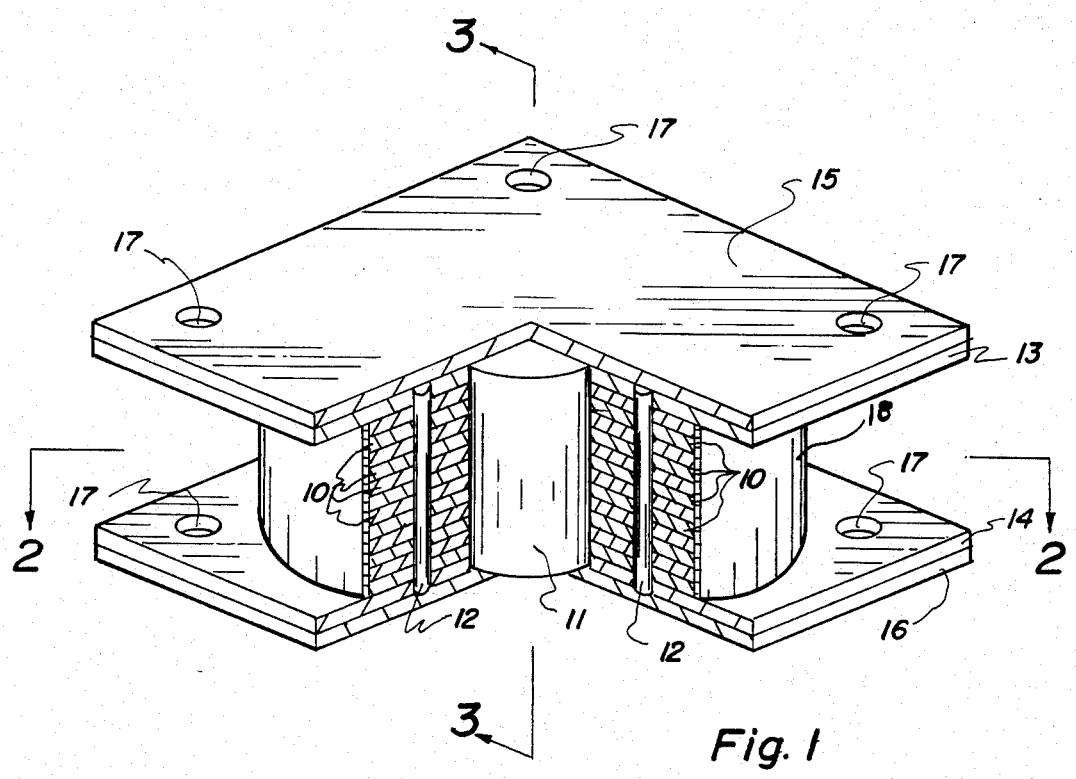
Figure 2:
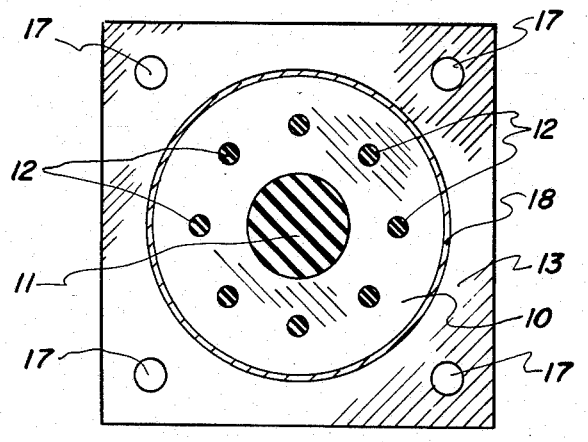
Figure 3:
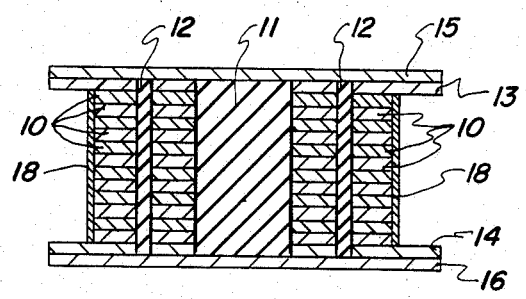
Figure 4:
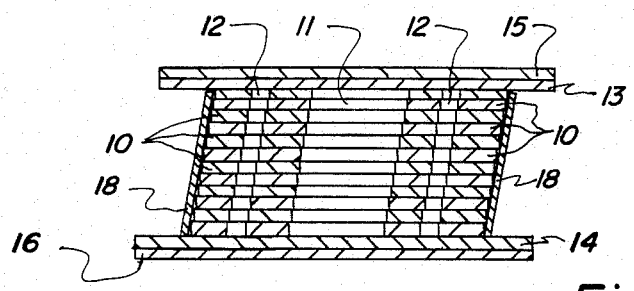

As shown in FIG. 1, a preferred embodiment of the invention has a plurality of flat, circular sliding plates, or rings 10 in this embodiment, disposed upon one another in a vertical mode. The plates 10 are preferably stainless steel coated with a material having a low coefficient of friction, such as Teflon or other similar material. The centers of plates 10 have apertures therein to accommodate a central core cylinder 11 constructed of rubber material.

In this embodiment, a plurality of peripheral rubber cores 12 is evenly spaced about the periphery of central core 11. Cores 12 extend through the vertical stack of plates 10. While both central core 11 and peripheral cores 12 are fitted in apertures contained in plates 10, the cores are not attached to the plates 10.

The vertical stack of plates 10 is secured top and bottom by a pair of connecting plates 13, 14 respectively secured to the top and bottom plates 10, of the vertical stack, preferably by welding or the like. Plates 13, 14 are also preferably constructed of stainless steel.

A pair of cover plates 15, 16 preferably constructed of steel are disposed top and bottom and secured respectively to the top and bottom connecting plates 13, 14. Both the pair of cover plates 15, 16 and the pair of connecting plates 13, 14 have appropriate apertures 17 therein as needed to secure the device to a foundation (not shown) and a structure (not shown).

Lastly, the stack of flat plates 10 is preferably covered with a rubber cover or skin 18 to protect the plates 10 from dust and corrosion.

Figure 5:
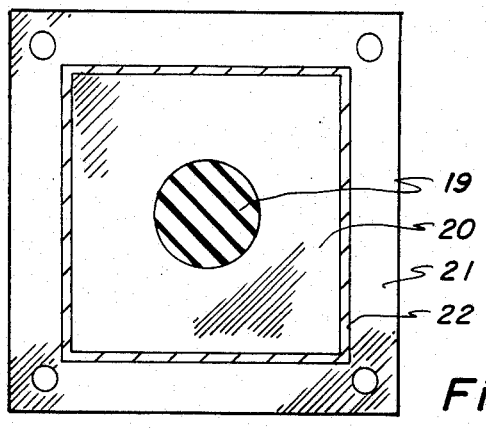

An alternative embodiment is illustrated in FIG. 5, in which the central rubber core 19 is circular in cross-section, but the sliding plates 20 are rectangular in shape. Top connecting plate 21 and rubber peripheral cover 22 are similar in construction and function to those disclosed in connection with the embodiment shown in FIG. 1.

Figure 6:
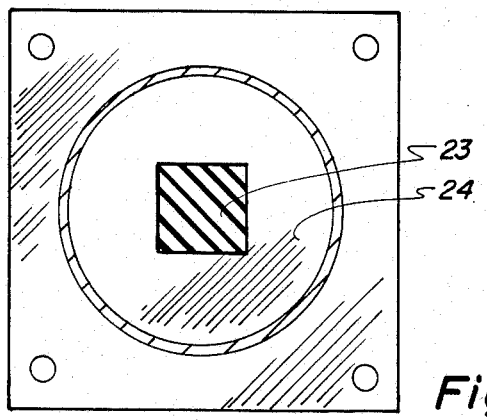
Figure 7:
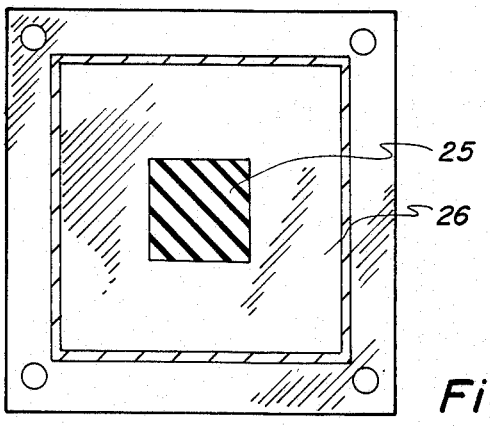

Two additional embodiments are illustrated in FIGS. 6 and 7. In FIG. 6, central core 23 is rectangular in cross-section while sliding plates 24 are circular in shape. In FIG. 7, central rubber core 25 is rectangular in cross-section and sliding plates 26 are also rectangular in shape.

It can be seen that the particular shape of the plates or cross-sectional shape of the rubber cores is not critical to the success of the invention.

The base isolator device accomplishes a variety of objectives and provides advantages not obtainable with devices of the prior art.

The lateral rigidity of the device is controlled by its coefficient of friction and the total lateral rigidity of the rubber cores. Once the lateral load exceeds the friction force, the lateral stiffness of the device will be that of the rubber cores. The base isolator device may be designed not to move laterally unless the applied excitations exceed a certain limit. This limit may be chosen high enough to prevent any lateral displacement at the base due to low amplitude ground motions or wind excitations.

Due to the lateral stiffness of the rubber cores, the permanent displacement (the residual displacement that remains after the ground motion stops) can be controlled.

Its maximum value is known at the outset. This maximum value depends on the total lateral stiffness of the rubber cores and the coefficient of friction of the sliding rings. As such, once provisions for necessary clearances are made, there will be no need for any repositioning.

The base isolator device performs effectively in any horizontal direction. As such, it can isolate structures from intense torsional excitations. Hence, asymmetric architectural features can be allowed without compromising safety. Also, due to the stiffness of the peripheral rubber cores, the maximum possible residual relative rotation of the superstructure about the vertical axis is known at the outset. The value of this rotation depends on the positions of the peripheral rubber cores and their lateral rigidities, the coefficient of friction, the radius of the sliding rings, and the location of the isolator devices relative to the structure. As in the case of permanent translational displacement, clearances can be provided for, and there will be no need for any repositioning operations.

The device eleminates the need to consider inelastic response in the design process, since at the outset the structures supported on the device are only subjected to wind or small excitation.

The base isolator device also provides protection for internal equipment. Since the structures will only be subjected to small amplitude excitations, the motions at the base of the internal equipment also will be limited. This may render unnecessary the consideration of the problem of equipment-structure interaction during severe excitations.

Since the rubber cores just span the total height of the device, it can provide larger lateral displacements with lower shear strains in the rubber as compared to a steel laminated rubber bearing of comparable height. Further, the horizontal stiffness of rubber depends on the normal load it carries, but in the present invention, no normal load is imposed on the rubber, and it is only subjected to shear loading. Therefore, the shear modulus for a specified level of shear strain and a given value of rubber's durameter hardness can easily be estimated.

As the rubber cores distribute the sliding displacement among many sliding layers, the sliding displacement on each surface will be a relatively small quantity. Therefore, the sliding velocity of each layer is also relatively small. This aids in maintaining an almost constant friction coefficient.

In a device of the invention, the interfacial friction force acts in parallel with the elastic force of the rubber cores. The resiliency of the rubber will reduce the high frequency effects attributed to friction isolators. This is particularly true for small coefficients of friction, which are the ones of interest in base isolation.

As the rubber cores do not carry any vertical loads and are not vulcanized to the sliding rings, the design and construction of the device is very simple.

The device is designed such that all of the vertical load is carried entirely by the sliding elements, and no vertical load is carried by the rubber cores. Therefore, the device is very rigid in the vertical direction. Its rigidity will be equal to that of the metal used to fabricate the sliding element. Hence, the device does not offer isolation against vertical ground motion. The response of structures to vertical ground motion may cause non-uniform distribution of vertical load on the isolators leading to variations in frictional resistance affecting the horizontal sliding displacements. There are two factors, however, which tend to limit this potential effect. First, the sliding of the device is restrained by the stiffness of the rubber cores. Second, the variation of the vertical load is of much higher frequencies as compared to the horizontal load. This leads to a high degree of decoupling and insignificant interaction between horizontal and vertical responses. Therefore, the vertical motions should not have any significant effects on horizontal response.

While this invention has been described and illustrated herein with respect to preferred embodiments, it is understood that alternative embodiments and substantial equivalents are included within the scope of the invention as defined by the appended claims.

I claim:

1. Base isolator apparatus for isolating structures from lateral ground motion, comprising in combination:

a plurality of abutting flat plates arranged in a vertical stack and being slideably disposed with respect to each other, each plate having a centrally oriented aperture therein:

an elongate, vertically oriented central rubber core unattachedly disposed within the apertures of said stack of plates and extending the full height of said stack; and means for securing said stack of plates to a base and a structure.

2. Apparatus as set forth in claim 1, including a plurality of elongate rubber cores unattachedly disposed peripherally around said central core through a plurality of apertures in said stack of plates, said peripheral cores extending from one end of said stack to the other.

3. Apparatus as set forth in claim 1, including a cover for said stack of flat plates.

4. Apparatus as set forth in claim 1, including a pair of connecting plates fixidly attached to the respective outside plates at each end of said stack of plates.

5. Apparatus as set forth in claim 1, wherein said means for securing said stack of plates comprises a pair of securing plates attached to each respective end of said stack of plates, said securing plates having apertures therein for securing said securing plates respectively to a structure and a base.

6. Apparatus as set forth in claim 1, wherein said flat plates are of stainless steel.

7. Apparatus as set forth in claim 6, wherein said stainless steel plates are coated with a material having a low coefficient of friction.

8. Apparatus as set forth in claim 1, wherein said central core is circular in cross-section.

9. Apparatus as set forth in claim 1, wherein said central core is rectangular in cross-section.

10. Apparatus as set forth in claim 1, wherein said flat plates are circular in shape.

11. Apparatus as set forth in claim 1, wherein said flat plates are rectangular in shape.

* * * * *